US010667620B2

(12) United States Patent
Grossman et al.

(10) Patent No.: US 10,667,620 B2
(45) Date of Patent: Jun. 2, 2020

(54) FUTON FRAMES INCLUDING A FIXED PIVOT POINT

(71) Applicant: Night and Day Furniture LLC, Vancouver, WA (US)

(72) Inventors: Joel Grossman, Petaling Jaya (MY); Howard Porter, Kuala Lumpur (MY)

(73) Assignee: Night and Day Furniture LLC, Vancouver, WA (US)

( * ) Notice: Subject to any disclaimer, the term of this patent is extended or adjusted under 35 U.S.C. 154(b) by 0 days.

(21) Appl. No.: 16/055,834

(22) Filed: Aug. 6, 2018

(65) Prior Publication Data

US 2018/0344039 A1 Dec. 6, 2018

Related U.S. Application Data

(63) Continuation of application No. 14/809,704, filed on Jul. 27, 2015, now Pat. No. 10,064,498.

(60) Provisional application No. 61/999,875, filed on Aug. 8, 2014.

(51) Int. Cl.

| | |
|---|---|
| ***A47C 17/175*** | (2006.01) |
| ***A47C 17/04*** | (2006.01) |
| ***A47C 1/032*** | (2006.01) |

(52) U.S. Cl.

CPC ..... *A47C 17/1756* (2013.01); *A47C 1/032* (2013.01); *A47C 17/04* (2013.01); *A47C 17/175* (2013.01); *A47C 17/1753* (2013.01)

(58) Field of Classification Search

CPC ..... A47C 17/04; A47C 17/16; A47C 17/17; A47C 17/175; A47C 17/1753; A47C 17/1756; A47C 1/032; A47C 1/0342

See application file for complete search history.

(56) References Cited

U.S. PATENT DOCUMENTS

| | | | | | |
|---|---|---|---|---|---|
| 3,458,877 | A * | 8/1969 | Edwards | A47C 17/1753 | 5/13 |
| 3,792,501 | A * | 2/1974 | Kery | A47C 4/54 | 297/452.41 |
| 3,887,229 | A * | 6/1975 | Plume | A47C 17/1753 | 297/65 |
| 3,905,053 | A * | 9/1975 | Vuchelich | A47C 17/1655 | 5/17 |
| 4,737,996 | A * | 4/1988 | Tiffany | A47C 17/1753 | 5/37.1 |
| 4,829,611 | A * | 5/1989 | Fireman | A47C 17/1753 | 5/37.1 |

(Continued)

*Primary Examiner* — Peter M. Cuomo
*Assistant Examiner* — David R Hare
(74) *Attorney, Agent, or Firm* — Harness, Dickey & Pierce, P.L.C.

(57) ABSTRACT

A frame subassembly of a foldable bed frame includes a seat deck, a back deck, and armrests. The frame subassembly includes a portion of the seat deck connected to a portion of the back deck; and a fixed pivot point connecting the back deck to the armrests such that the fixed pivot point between the back deck and the armrests does not slide when the foldable bed frame transitions between a folded state and an unfolded state. The foldable bed frame may include a hanger connecting the armrest to the back deck such that the fixed pivot point therebetween is offset. The foldable bed frame may further include an assistance device configured to store elastic energy during a first transition, and release the stored elastic energy during a second transition.

11 Claims, 13 Drawing Sheets

(56) References Cited

U.S. PATENT DOCUMENTS 4,875,244 A * 10/1989 Tremblay ..... A47C 17/1753 5/37.1
4,996,730 A * 3/1991 Fireman ..... A47C 17/175 5/37.1
5,083,333 A * 1/1992 Newton ..... A47C 17/1753 5/37.1
5,146,640 A * 9/1992 Barton ..... A47C 17/175 5/37.1
5,153,952 A * 10/1992 Barton ..... A47C 17/175 5/37.1
5,271,109 A * 12/1993 Markel ..... A47C 17/1756 5/37.1
5,485,638 A * 1/1996 Newton ..... A47C 17/1756 5/37.1
5,628,076 A * 5/1997 Newton ..... A47C 17/1756 5/37.1
5,790,993 A * 8/1998 Roma ..... A47C 17/1756 5/37.1
5,815,858 A * 10/1998 Dodge ..... A47C 17/1753 5/37.1
5,940,907 A * 8/1999 Stoler ..... A47C 17/1753 5/37.1
5,956,785 A * 9/1999 Fireman ..... A47C 1/03294 5/37.1
6,061,848 A * 5/2000 Roma ..... A47C 17/1753 5/37.1
6,138,299 A * 10/2000 Roma ..... A47C 17/1753 5/37.1
6,138,300 A * 10/2000 Burch ..... A47C 17/1753 5/37.1
6,349,431 B1 * 2/2002 Meade ..... A47C 17/162 5/37.1
6,427,261 B1 * 8/2002 Chadbourn ..... A47C 17/2073 5/18.1
6,715,166 B1 * 4/2004 Grossman ..... A47C 17/1753 5/37.1
7,134,153 B2 * 11/2006 Kanthasamy ..... A47C 17/1753 5/37.1
7,540,042 B2 * 6/2009 Chen ..... A47C 1/023 5/37.1
8,438,676 B2 * 5/2013 Murphy ..... A47C 3/16 5/28
9,119,475 B1 * 9/2015 Leal ..... A47C 17/17
9,980,572 B2 * 5/2018 Thurow ..... A47C 17/17
10,064,498 B2 * 9/2018 Grossman ..... A47C 17/1756
2003/0172455 A1 * 9/2003 Roma ..... A47C 17/1753 5/37.1
2005/0028272 A1 * 2/2005 Kanthasamy ..... A47C 17/16 5/37.1

* cited by examiner

FUTON FRAMES INCLUDING A FIXED PIVOT POINT

RELATED APPLICATION

This application is a continuation application of U.S. application Ser. No. 14/809,704, filed on Jul. 27, 2015, which claims priority under 35 U.S.C. § 119 to U.S. Provisional Application No. 61/999,875 filed on Aug. 8, 2014, the entire contents of each of which are hereby incorporated by reference in their entirety.

FIELD

Example embodiments relate generally to futon frames, and more particularly to futon frames including a fixed pivot point. In some example embodiments, the fixed pivot point may be offset.

BACKGROUND

The statements in this section merely provide background information related to example embodiments and may not constitute prior art.

Often, furniture apparatuses capable of more than one function are used in environments (e.g., residential, commercial, etc.) where space is limited. For example, futon beds or other like foldable beds may be used in such environments as sitting furniture (e.g., couches, sofas, etc.) and lying and/or sleeping furniture (e.g., beds, etc.). In these environments, futon beds may make more efficient use of the limited space and may relieve the need for additional furniture. However, many futon beds are difficult to transition from the sitting position to a lying position, or vice versa.

SUMMARY

Example embodiments relate to a futon frame that includes a pivot point.

Some example embodiments relate to frame subassembly of a foldable bed frame.

In some example embodiments, the foldable frame includes a seat deck, a back deck and armrests connected via rails. The frame subassembly may include a portion of the seat deck connected to a portion of the back deck; and a fixed pivot point connecting the back deck to the armrests such that the fixed pivot point between the back deck and the armrests does not slide when the foldable bed frame transitions between a folded state and an unfolded state.

In some example embodiments, the frame subassembly may include a hanger connecting the armrest to the back deck such that the fixed pivot point therebetween is offset, wherein a first one of the hangers and the armrests have a first opening thereon configured to receive a first protrusion extending away a second one of the hangers and the armrests, and the armrests include guides configured to receive second protrusions extending away from side panels of the seat deck.

In some example embodiments, the portion of the seat deck connected to the portion of the back deck forms a first joint, the first joint includes a hinge mechanism that connects the portion of the seat deck to the portion of the back deck, and the hinge mechanism is configured to rotate the seat deck relative to the back deck.

In some example embodiments, the guide is configured to, direct a first motion of the foldable bed frame including a first transition from a folded state to an unfolded state, and direct a second motion of the foldable bed frame including a second transition from the unfolded state to the folded state.

In some example embodiments, the seat deck and the back deck form a sleeping platform in the unfolded state and a chair platform in the folded state.

In some example embodiments, the frame subassembly further includes an assistance device configured to store elastic energy during the first transition, and release the stored elastic energy during the second transition, wherein the stored elastic energy provides a force for initiating the first transition.

In some example embodiments, the frame subassembly further includes a plurality of pulleys installed on a bottom surface of the seat deck, and the assistance device includes an elastic cord attached to a first position on a back deck rail of the back deck and wound through the plurality of pulleys and secured to a second position on the back deck rail of the back deck.

In some example embodiments, a pair of front pulleys are on a front of the bottom surface of the seat deck oriented in a first direction, and a pair of rear pulleys are on a rear of the bottom surface of the seat deck oriented in a second direction, the second direction being rotated 90 degrees with respect to the first direction.

In some example embodiments, the assistance device is an elastic object connected to the arm rest and one of the seat deck and the back deck, the foldable bed frame is configured to be in one of an unfolded state and a folded state, and the elastic object is configured to, store elastic energy in the unfolded state, and release the stored elastic energy during a transition from the unfolded state to the folded state.

In some example embodiments, a first end of the elastic object is connected to the arm rest and a second end of the elastic object is connected to one of the seat deck and the back deck.

In some example embodiments, the elastic object is a coiled extension spring, the coiled extension spring configured to store the elastic energy as a compressive force is applied thereto.

Some example embodiments relate to a frame for a foldable bed.

In some example embodiments, the frame includes a pair of armrests that each include an armrest protrusion and a guide; a back deck connected to the armrests via hangers, the hangers having a back deck opening therein, the back deck opening configured to receive the armrest protrusion extending away from the armrest; and a seat deck connected to the armrest via a seat deck protrusion and connected to the back deck via a frame subassembly, the seat deck protrusion configured to slide in the guide to guide the seat deck during a first transition of the foldable bed from a folded state to an unfolded state and a second transition of the foldable bed from the unfolded state to the folded state.

In some example embodiments, the frame subassembly includes a hinge mechanism that connects the seat deck to the back deck, and the hinge mechanism is configured to rotate the seat deck relative to the back deck.

In some example embodiments, the guide includes (i) a first portion configured to guide the seat deck during the first transition and the second transition, and (ii) a second portion configured to lock the frame when the foldable bed is in the unfolded state.

In some example embodiments, the seat deck and the back deck form a sleeping platform in the unfolded state and a chair platform in the folded state.

In some example embodiments, the hanger is generally perpendicular to a back deck rail of the back deck.

In some example embodiments, the frame subassembly further comprises: an assistance device configured to store elastic energy during the first transition, and release the stored elastic energy during the second transition, wherein the stored elastic energy provides a force for initiating the first transition.

In some example embodiments, a plurality of pulleys are installed on a bottom surface of the seat deck, and the assistance device includes an elastic cord attached to a first position on a back deck rail of the back deck and wound through the plurality of pulleys and secured to a second position on the back deck rail of the back deck.

Some example embodiments relate to a frame subassembly for a foldable bed frame.

In some example embodiments, the frame subassembly includes a hanger configured to connect a back deck of the foldable bed to arm rests such that a pivot point therebetween is offset; and an assistance device configured to provide elastic energy for transitioning the foldable bed frame from an unfolded position to a folded position.

Some example embodiments relate to a method for configuring a foldable bed frame.

In some example embodiments, the method includes installing a hanger configured to connect a back deck of the foldable bed to arm rests such that a pivot point therebetween is offset; and securing an assistance device to the foldable bed frame, the assistance device configured to provide elastic energy for transitioning the foldable bed frame from an unfolded position to a folded position.

Some example embodiments relate to a kit for assembling a foldable bed frame that includes a frame subassembly.

In some example embodiments the kit includes a first armrest piece and a second armrest piece, the first armrest piece and the second armrest piece configured to each connect to a back deck piece, a seat deck piece, a first rail, and a second rail such that the first rail and the second rail are perpendicular to each of the first armrest piece and the second armrest piece, wherein the seat deck piece is configured to connect to the back deck piece to form a sleeping platform, the first armrest piece and the second armrest piece having guides therein, protrusion associated with seat deck piece configured to be received by the guides, the backrest having hangers protruding therefrom, protrusions associated with the first armrest piece and the second armrest piece configured to be received by back rest openings in the hangers such that pivot points between the back deck piece and the first armrest piece and the second armrest piece is offset.

DRAWINGS

The drawings described herein are for illustration purposes only and are not intended to limit the scope of the present disclosure in any way.

DESCRIPTION

Figure 1:
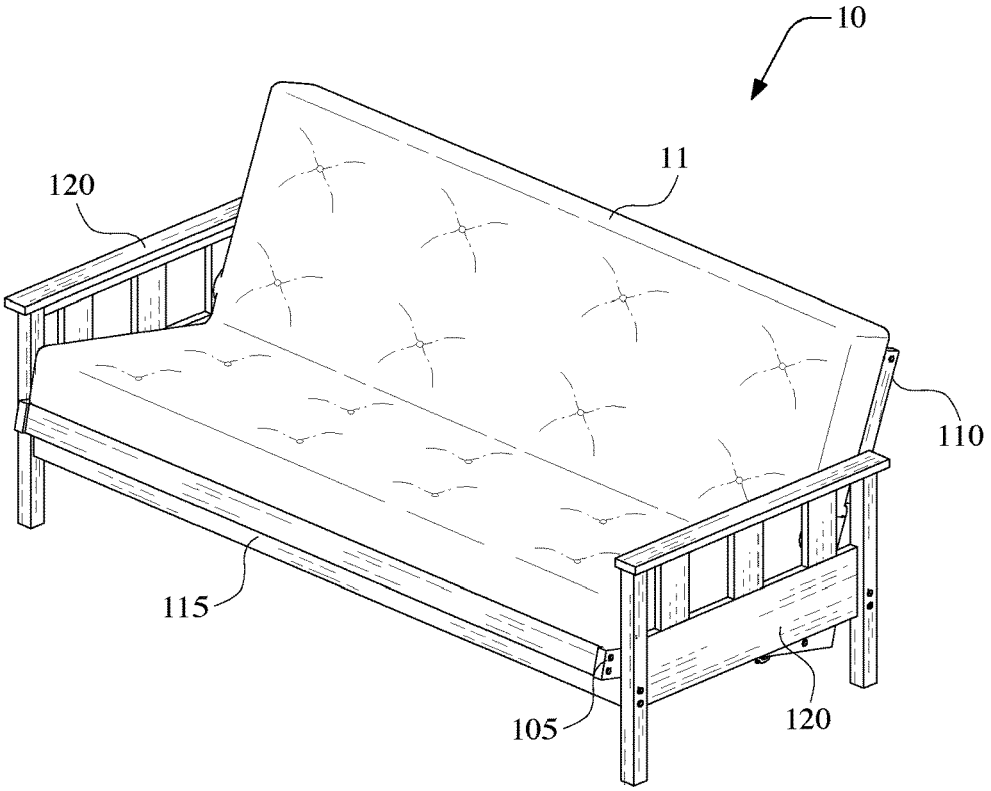
FIG. 1 is a front, right perspective view of a foldable bed frame and a bed in a folded position according to an example embodiment.

The following description is merely an example and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the example embodiments to those skilled in the art.

Example embodiments relate to a futon frame that includes a pivot point. Some example embodiments provide that the futon frame may include at least one assistance device configured to store kinetic energy.

Figure 2:
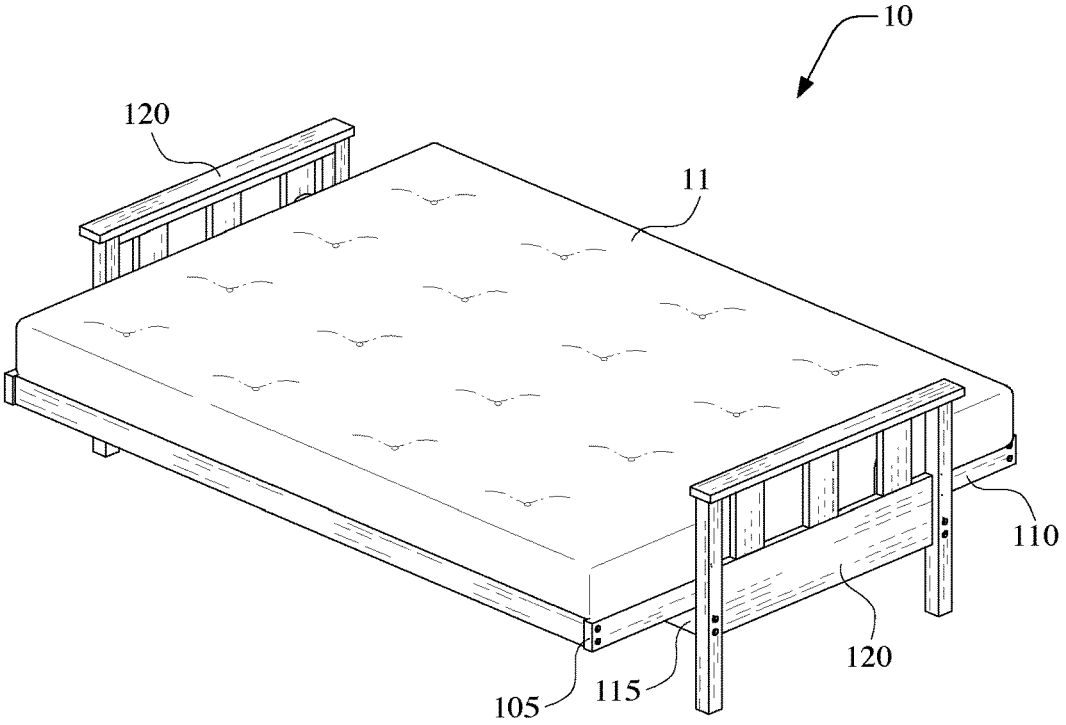
FIG. 2 is a front, right perspective view of a foldable bed frame and a bed in an unfolded position according to an example embodiment.
Figure 3:
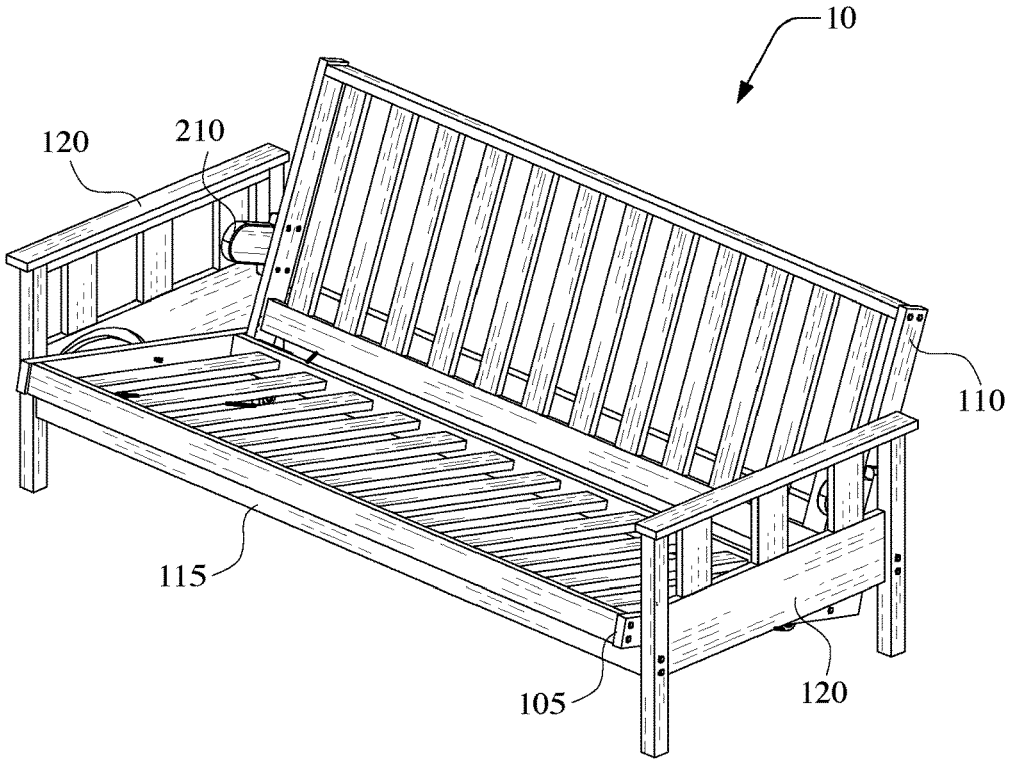
FIG. 3 is a front, right perspective view of the foldable bed frame in the folded position according to an example embodiment.
Figure 4:
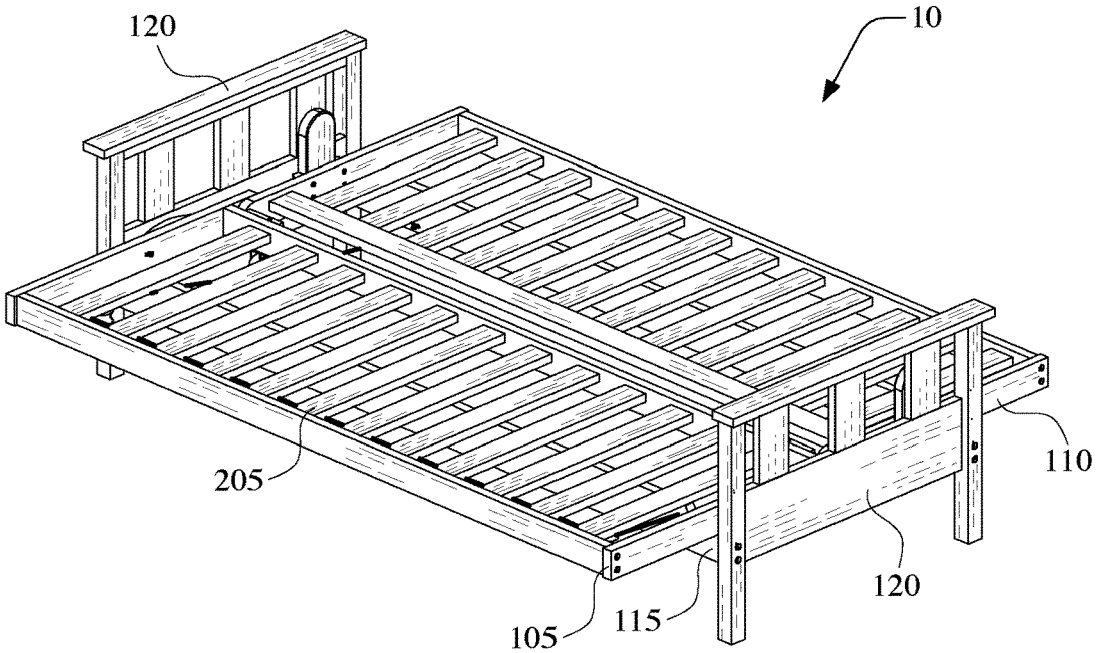
FIG. 4 is a front, right perspective view of the foldable bed frame in the unfolded position according to an example embodiment.
Figure 5:
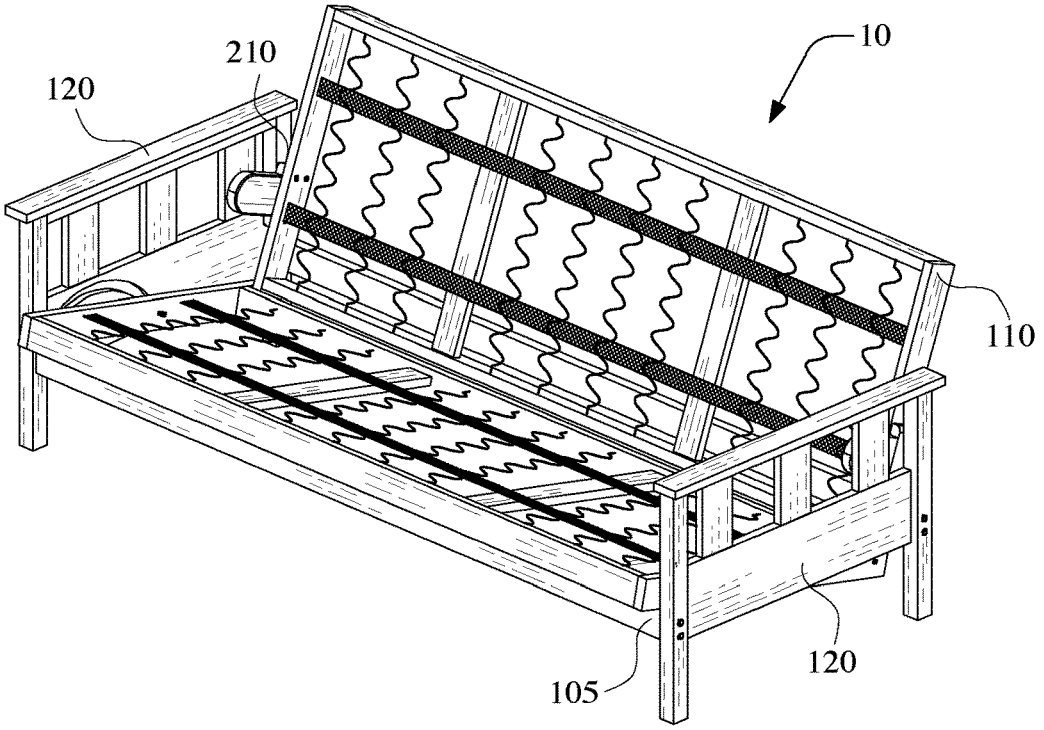
FIG. 5 is a front, right perspective view of the foldable bed frame in the folded position according to an example embodiment.
Figure 6:
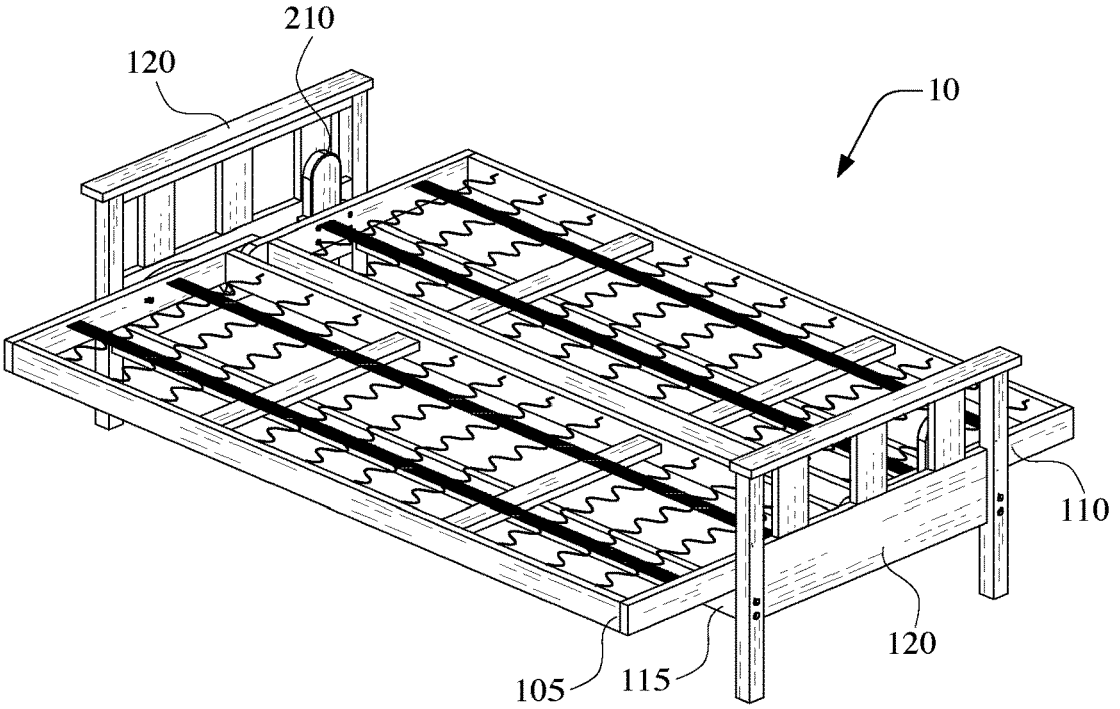
FIG. 6 is a front, right perspective view of the foldable bed frame in the unfolded position according to an example embodiment.

FIGS. 1, 3 and 5 are front, right perspective views of a futon frame 10 (also referred to as "foldable frame 10", "foldable bed frame 10", and the like) in a folded position according to an example embodiment. FIGS. 2, 4 and 6 are front, right perspective views of the futon frame 10 of FIG. 1 in an unfolded position.

Referring to FIGS. 1 to 6, the foldable frame 10 includes a seat deck 105, a back deck 110, rails 115, and armrests 120. The foldable frame 10 is configured to have bed 11 in the form of one or more of foldable mattress or a two-piece mattress positioned thereon.

The seat deck 105 and the back deck 110 form a sleeping platform 200 (as described in detail later) when the foldable bed frame 10 is in an unfolded state. The seat deck 105 and the back deck 110 form a chair platform 200 (as described in detail later) when the foldable bed frame 10 is in a folded state.

The sleeping platform 200 and/or the chair platform 200 support the bed 11. The rails 115 support the sleeping platform 200 when the foldable frame 10 is in the unfolded position. When the foldable bed frame 10 is in the folded position, a first one of the rails 115 supports at least a portion of the seat deck 105 and a second one of the rails 115 supports at least a portion of the back deck 110.

Each of the seat deck 105 and the back deck 110 include a set of slats 205. The slats 205 support the bed 11.

The back deck 110 is connected to each of the armrests 120 via hangers 210.

Figure 7:
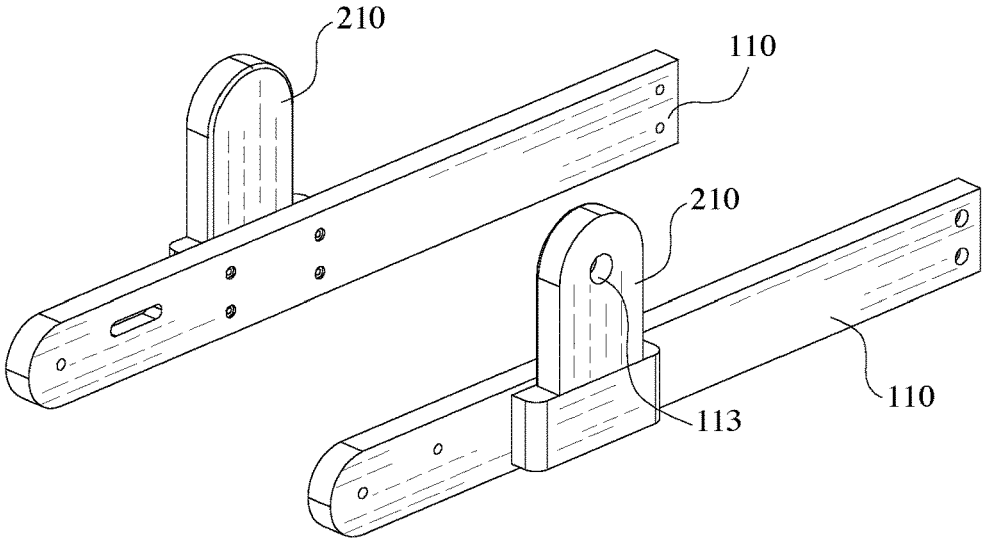
FIG. 7 illustrates an enlarged perspective view of a portion of the back deck of the foldable bed frame according to an example embodiment.
Figure 8:
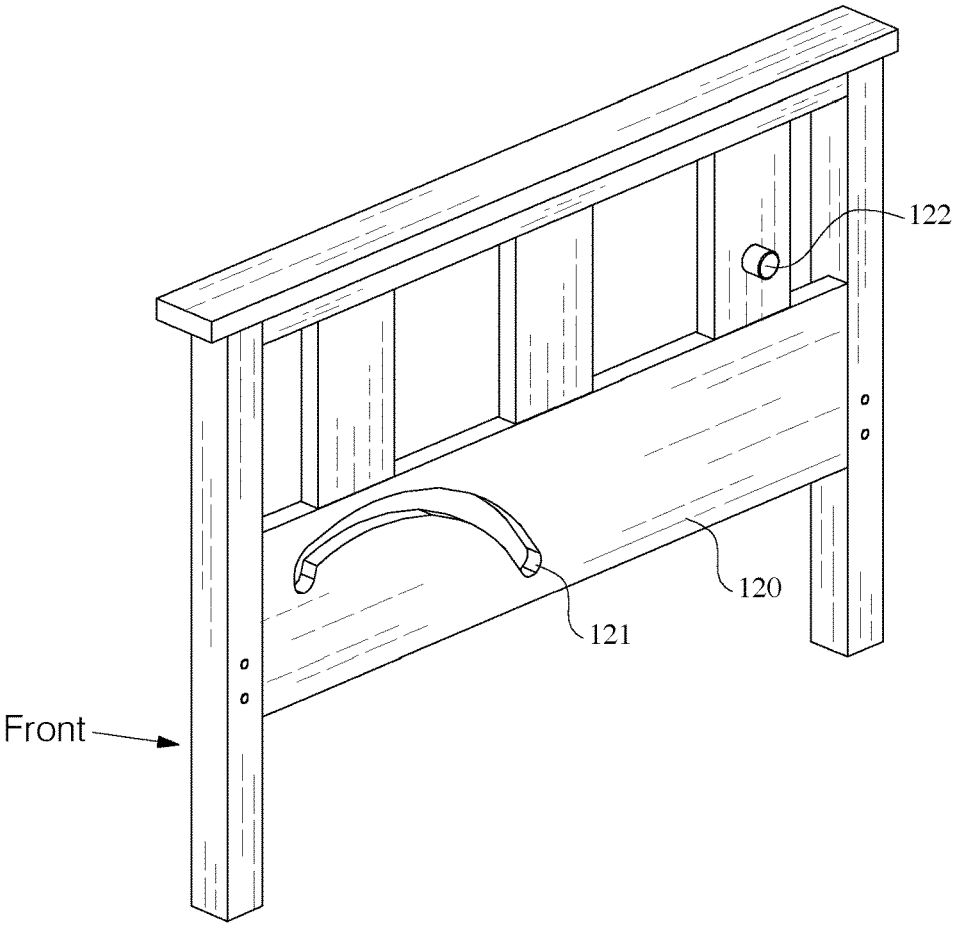
FIG. 8 illustrates an enlarged perspective view of armrests of the foldable bed frame according to an example embodiment.

FIG. 7 illustrates an enlarged perspective view of a portion of the back deck 110 of the foldable bed frame 10 according to an example embodiment; and FIG. 8 illustrates an enlarged perspective view of armrests 120 of the foldable bed frame 10 according to an example embodiment.

Referring to FIGS. 7 and 8, the back deck 110 may include a hanger 210 connected to side sections of the back deck 110. The armrests 120 include an armrest protrusion 122 that extends out from the armrest 120 and is configured to pivotally couple with a corresponding one of the hangers 210 such that a pivot point therebetween is offset to counterbalance the weight of the back deck 110 and the bed 11.

For example, the hanger 210 may include a back deck opening 113. The back deck opening 113 is configured to receive a corresponding one of the armrest protrusions 122 that extend out from each of the armrests 120. The back deck opening 113 may be an opening or other like cavity that is located within each of hangers 210.

The hangers 210 may offset a pivot point between the armrests 120 and the back deck 110 such that the pivot point is located further up the back deck 110. For example, approximately ⅓ the distance up the back deck 110.

However, example embodiments are not limited thereto. For example, in other example embodiments, the hanger 210 may be connected to the armrests 120, and the protrusions 122 may protrude from the back deck 110.

The pivot point may be called a fulcrum and the seat deck 105 and back deck 110 may be called a lever, such that as the lever rotates around the fulcrum, points farther from this pivot move faster than points closer to the pivot point.

The ratio of the input force to the output force, known as the mechanical advantage MA of the lever, may be defined as the ratio of the input to output forces, as illustrated in Equation 1:

$$MA = \frac{F_B}{F_A} = \frac{a}{b}. \qquad \text{Equation 1}$$

where, MA is the mechanical advantage, $F_A$ is the input force applied by the user at point A (e.g., the front rail of the seat deck 105) to transition the bed 10 to the foldable state (seating position), $F_B$ is the output force applied at point B where the hanger 210 intersects the back rest 110, a is the distance from the fulcrum to the point A where the input force $F_A$ is applied, and b is the distance from the fulcrum to the point B where the output force is applied. Therefore, as shown in Equation 1, since the distance a from the fulcrum to where the input force is applied (point A) is greater than the distance b from the fulcrum to where the output force is applied (point B), then the lever amplifies the input force, thus, reducing the magnitude of the input force required to transition the bed to the foldable state. Therefore, when transitioning the foldable bed 10 from an unfolded state to a folded state, there may be less force required to transition to foldable bed 10 due to the hanger 210.

In a conventional futon frame, a user may have difficulty moving the back deck up or down when transitioning the futon frame between the folded state and the unfolded state. This difficulty may be exacerbated when the weight a mattress is on the futon frame.

For example, a conventional futon frame may not have a mechanism to assist the user to lift the back deck up from the unfolded state. Instead, the user may forcefully lift the back deck and mattress up until the back deck reaches an angle associated with the folded state. As another example, a conventional futon frame may include a lock-and-lever system to assist the user to lift the back deck up from the unfolded state. Rather than lift the back deck, the lock-and-lever system may allow the user to lift the seat deck upward until the seat deck is positioned (or, alternatively, drops) into a lock position so that the seat deck is roughly forming an "L" shape together with the back deck. Once locked, the seat deck part of the "L" can be forcefully pushed downward; and in doing so the back deck is naturally lifted up into the upright seating position.

Further, a conventional futon frame may include two runners (or, alternately, protrusions) positioned on each side of the back deck, and two groove tracks in each futon arm corresponding to the runners, such that the two groove tracks in each futon arm receive the two runners on each side of the back deck. When the conventional frame transitions from the folded state to the unfolded state, the back deck of runner runs from one end of its groove to the other end.

In contrast, in one or more example embodiments, the foldable bed frame 10 has fixed pivot points one each side of the back deck. In some example embodiments, the fixed pivot points may be offset with a hanger 210. However, example embodiments are not limited thereto. For example, in other example embodiments, the foldable bed frame 10 may not include a hanger to offset the fixed pivot points. In some example embodiments, the fixed pivot point may be positioned roughly one third of the distance up along the side rail of the back deck 110.

The fixed pivot may be the aforementioned fulcrum. The futon frame 10 can be balanced on the fulcrum and the mechanical advantage (MA) gained by incorporating the fulcrum may depend on the position of the fulcrum and the weight and length of the opposing sides, which may be called levers. The mechanical advantage is mathematically illustrated in the formula above.

One or more example embodiments utilize the mechanical advantage of a fulcrum positioned in relation to the levers (the decks) on each side thereof.

In one or more example embodiments, the fulcrum may be the point at which the hanger 210 connects to the futon arms 120 at a fixed point. By utilizing the fixed fulcrum point, in one or more example embodiments, when transitioning from the unfolded state to the folded state, the mechanical advantage MA gained by the seat deck 10 as lever may lift the back deck upright with relatively greater ease.

Further, in one or more example embodiments, when transitioning from the folded state to the unfolded state using the seat deck as a lever, due to the same weight considerations of the back deck and mattress, the dropping of the back deck 110 from upright seating position down to sleeping position may be controlled with relatively greater ease.

Further, as illustrated in FIG. 7, in addition to including the arm rest protrusion 122, the arm rests 120 may also include guides 121. The guides 121 may direct a first motion of the foldable bed frame 10 from the folded state to the unfolded state, and direct a second motion of the foldable bed frame 10 from the unfolded state to the folded state. In this way, the guide 121 may act as a track and/or guide for transitioning the foldable bed frame 10 from the folded state to the unfolded state and for transitioning the foldable bed frame 10 from the unfolded state to the folded state. The guides 121 may include a lock point located a front of the grooves, the lock point may allow the guides 121 to lock the foldable bed frame 10 into the unfolded state such that a user may be required to lift the seat deck 105 to unlock the foldable bed frame 10.

As discussed above, in one or more example embodiments, the arm rests 120 may include a groove track 121 at the front of the arm. The groove track 121 may receive a runner (or protrusion) 106 attached to the seat deck 105. During conversion, the pulling and lifting motion of the seat deck 105 by the user may be controlled (or, alternatively, restricted) by the path the runner 106 follows in the groove track 121. Thereby the path the seat deck as lever follows during conversion is optimized to take best advantage of its mechanical advantage as lever in relation to the fulcrum.

Figure 9:
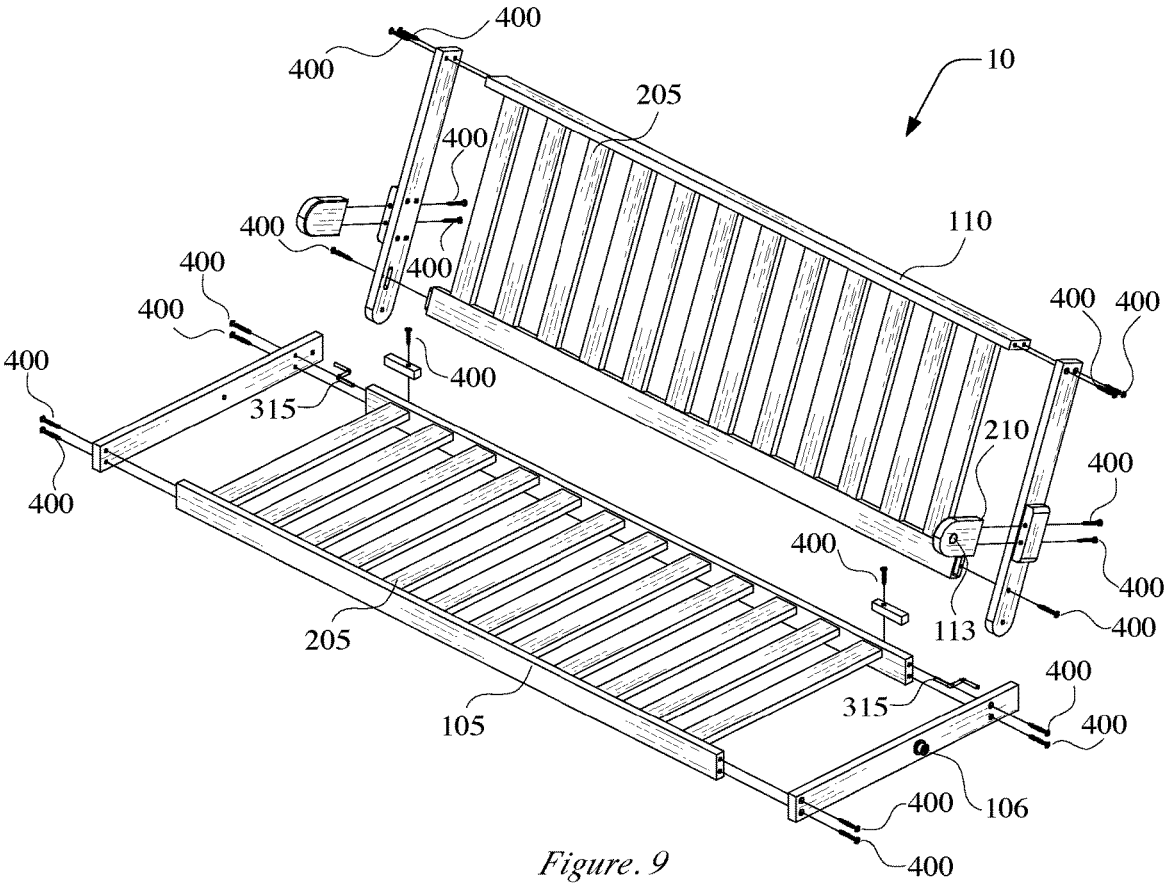
FIGS. 9 and 10 show exploded perspective views of the foldable bed frame according to an example embodiment.
Figure 10:
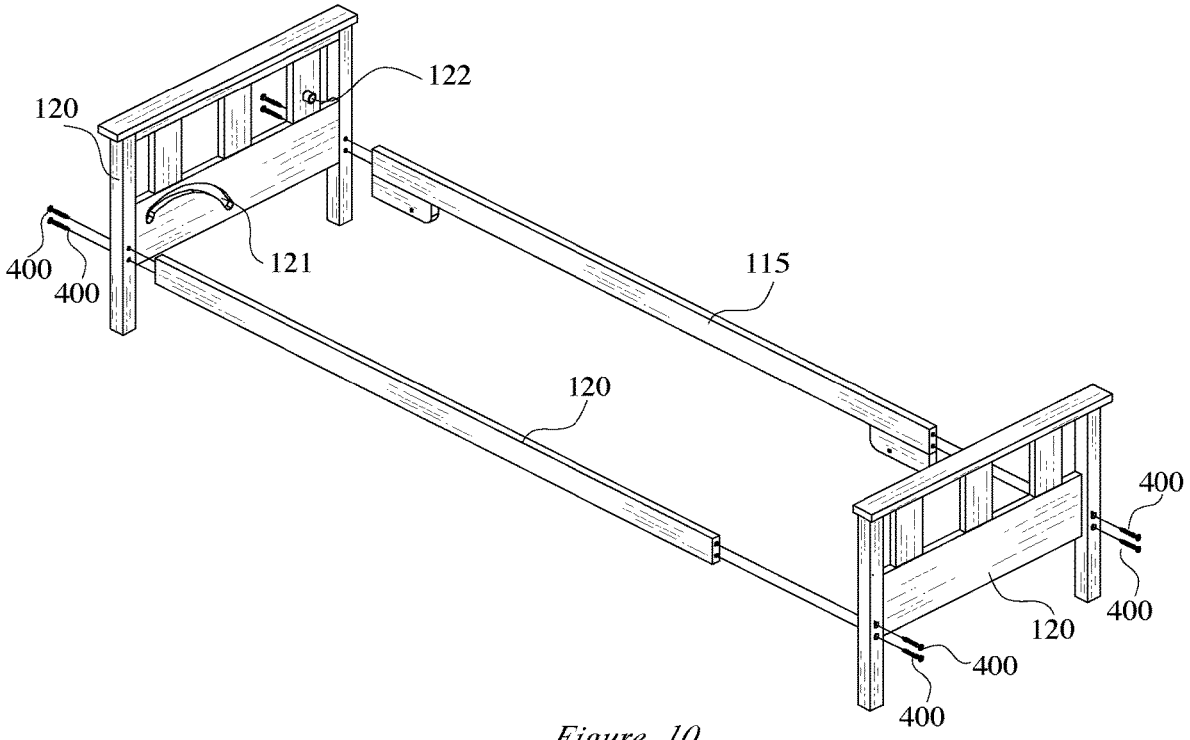
Figure 11:
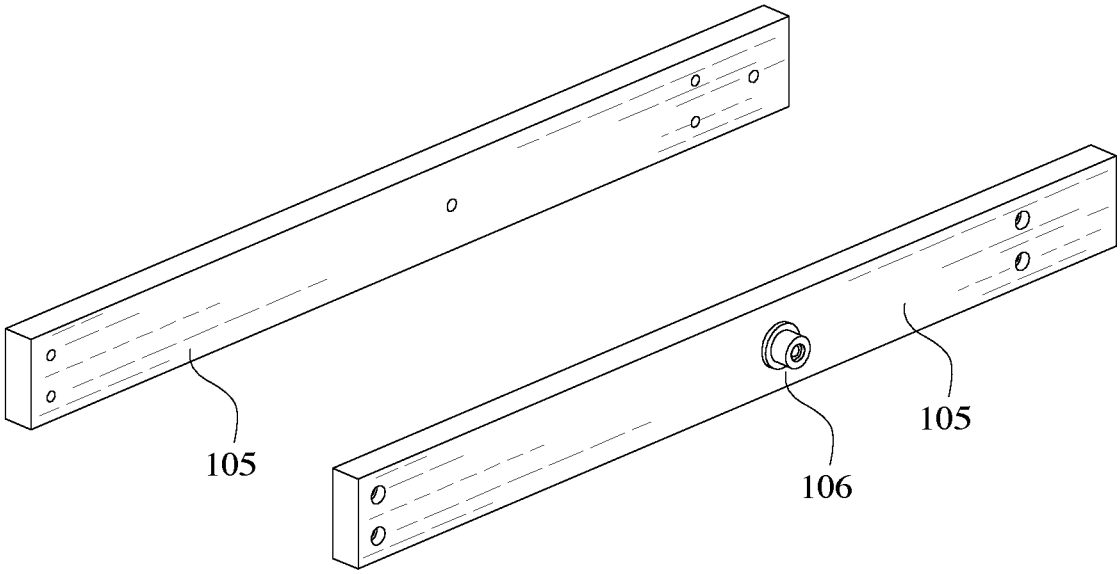
FIG. 11 is an enlarged perspective view of seat deck connector rails of the foldable bed frame according to an example embodiment.

FIGS. 9 and 10 show exploded perspective views of the foldable bed frame according to an example embodiment. FIG. 11 is an enlarged perspective view of seat deck connector rails of the foldable bed frame according to an example embodiment.

Referring to FIGS. 9 to 11, the seat deck 105 is connected to the armrest via a seat deck protrusion 106. The seat deck protrusion 106 is configured to be received by a guide 121. The guide 121 may direct a first motion of the foldable bed frame 10 from the folded state to the unfolded state, and direct a second motion of the foldable bed frame 10 from the unfolded state to the folded state. In this way, the guide 121 may act as a track and/or guide for transitioning the foldable bed frame 10 from the folded state to the unfolded state and for transitioning the foldable bed frame 10 from the unfolded state to the folded state.

The seat deck 105 includes a set of slats 200 that may fit into grooves in top and bottom panels thereof, and the side panels of the seat deck 105 may be connected to the top panels by way of fasteners 400. The side panels of the seat deck 105 each include one of the seat deck protrusions 106 that is configured to be received by a corresponding one of the guide 121. The seat deck 105 also includes pin 315, which may be used to connect the seat deck 105 to the back deck 110 (see e.g., FIG. 10). Pin 315 may enable the seat deck 105 and the back deck 110 to move or otherwise transition from the unfolded state to the folded state (i.e., transition from the sleeping platform 200 to the chair platform 200) and vice versa. Thus, the pin 315 hingedly connects the seat deck 105 to the back deck 110. The region and/or area of the foldable bed frame 10 where the seat deck 105 connects to the back deck 110 may be referred to as a "first joint". The first joint may include any type of hinge mechanism (e.g., pin 315 in combination with one or more other devices) that may allow the seat deck 105 to connect or otherwise attach to the back deck 110. The hinge mechanism may be configured to rotate the seat deck relative to the back deck The back deck 110 includes a set of slats 205 may fit into grooves in top and bottom panels thereof, and the side panels of the back deck 110 may be connected to the top and bottom panels by way of fasteners 400. The hangers 210 may be connected to a corresponding one of the side panels of the back deck 110 by way of fasteners 400. Each of the protrusions 210 may include a back deck opening 113.

Fasteners 400 may be any type of fastening device (e.g., nails, screws, and the like). In some embodiments, fasteners 400 may include an adhesive (e.g., glue, epoxy resin, and the like) and/or by any other means for fastening one object to another object.

The rails 115 may connect or otherwise attach to armrests 120 by way of fasteners 400. Each of the armrests 120 and each of the rails 115 are configured to connect to each other such that each of the rails 115 are perpendicular to each of the armrests 120. As shown, the armrests 120 include a guide 121 that is configured to receive a corresponding seat deck protrusion 106. As shown, armrests 120 each include an armrest protrusion 122 that extends out from each of the armrests 120 and is configured to be received by the back deck opening 113.

Figure 12:
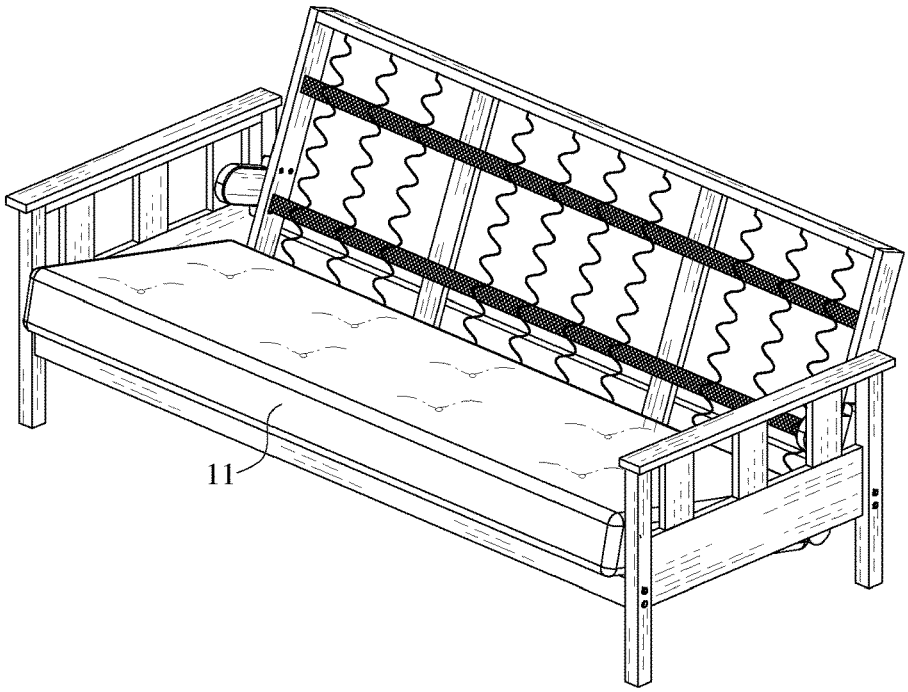
FIGS. 12 to 14 illustrate a foldable bed frame having a two-part bed according to some example embodiments.
Figure 13:
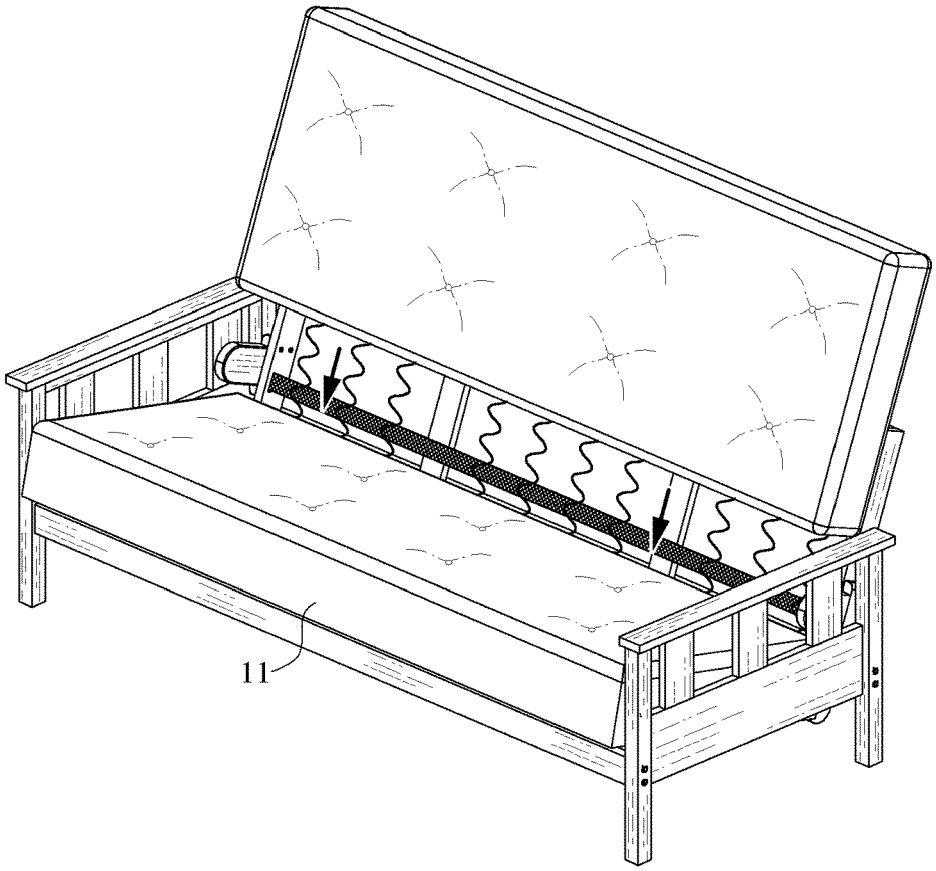
Figure 14:
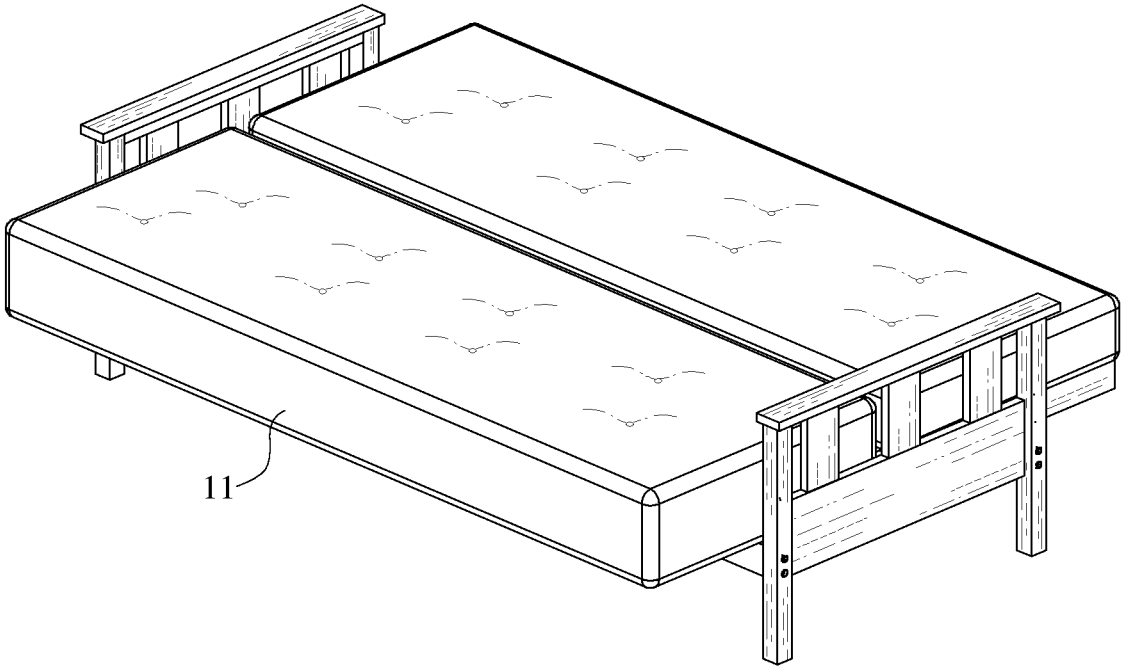
Figure 15:
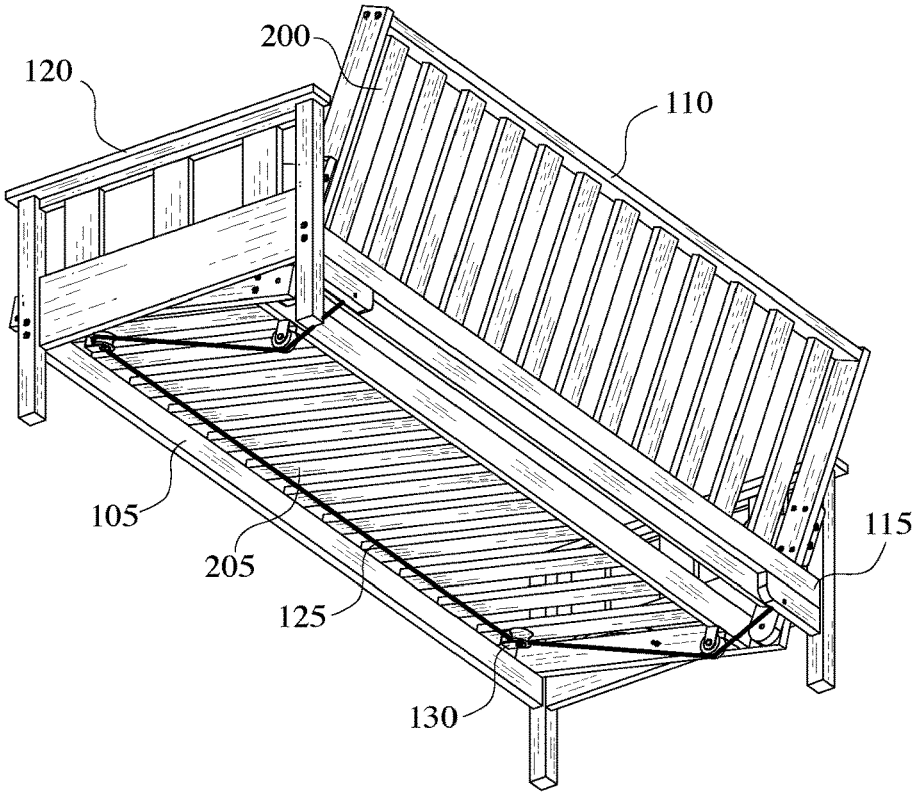
FIGS. 15 to 20 illustrate a foldable bed frame including an assistance mechanism according to an example embodiment.
Figure 16:
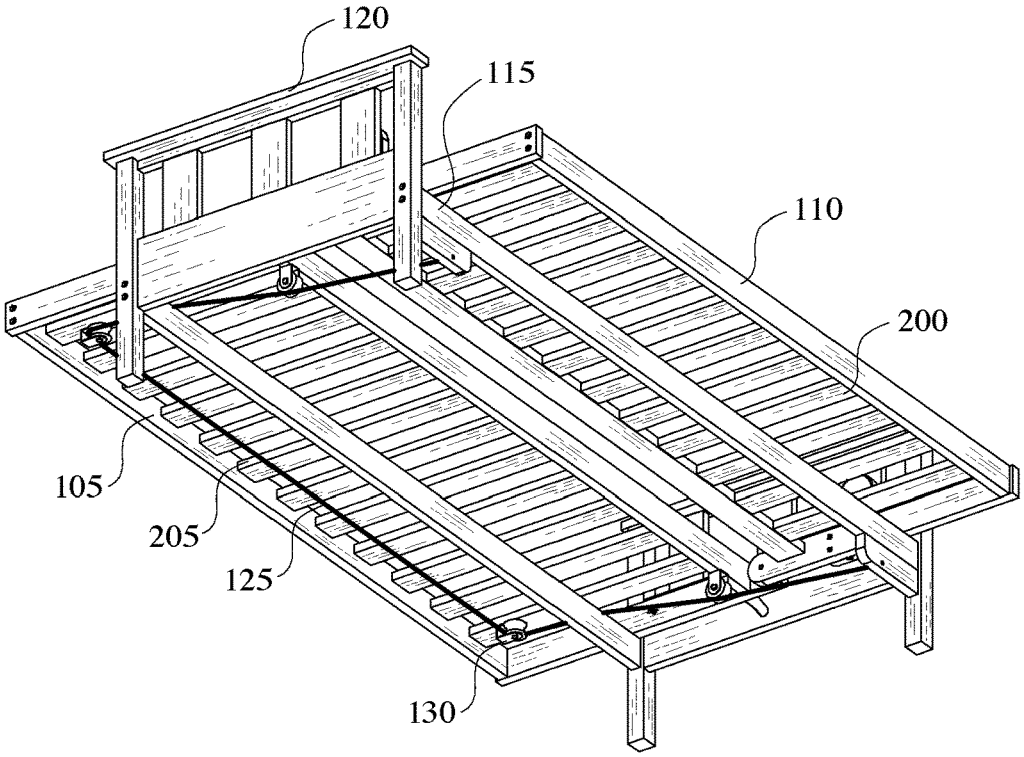
Figure 17:
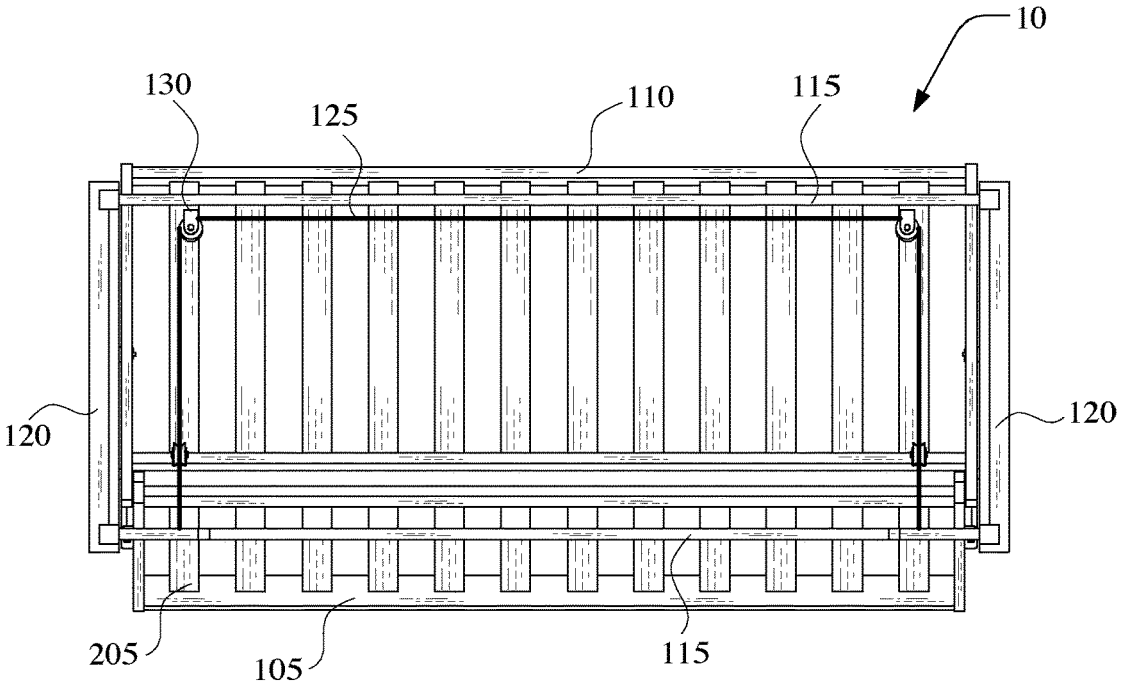
Figure 18:
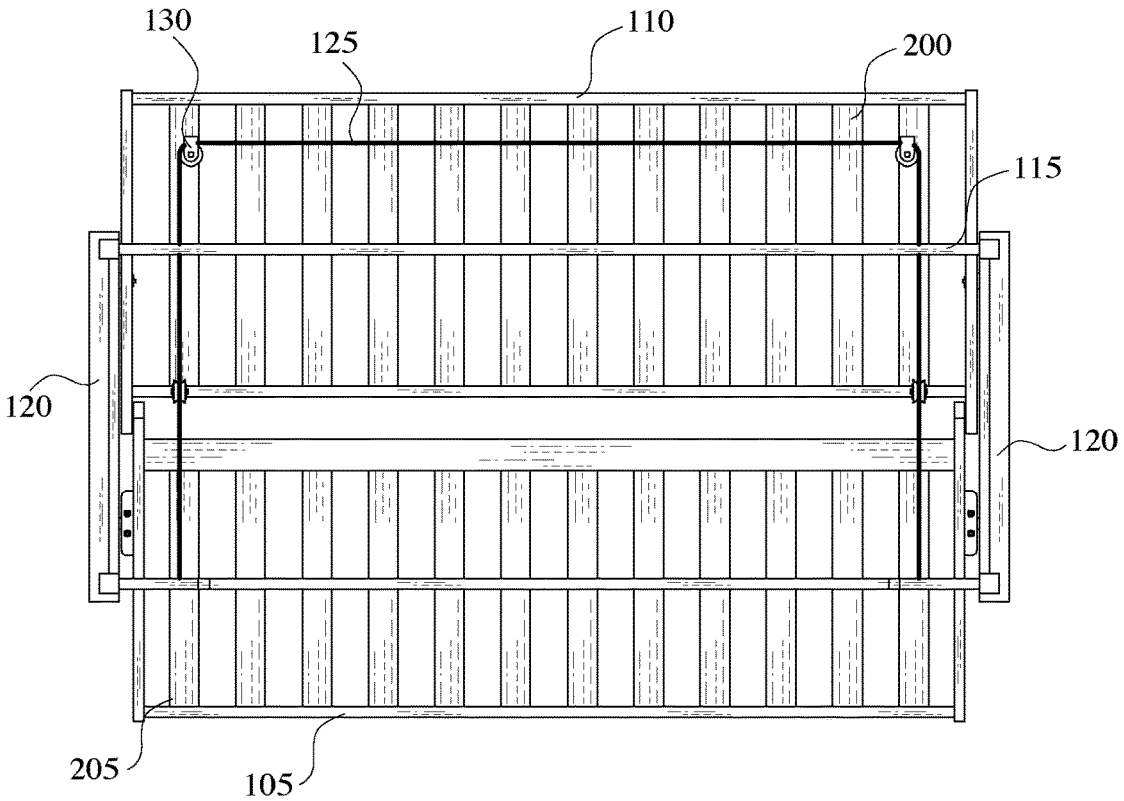
Figure 19:
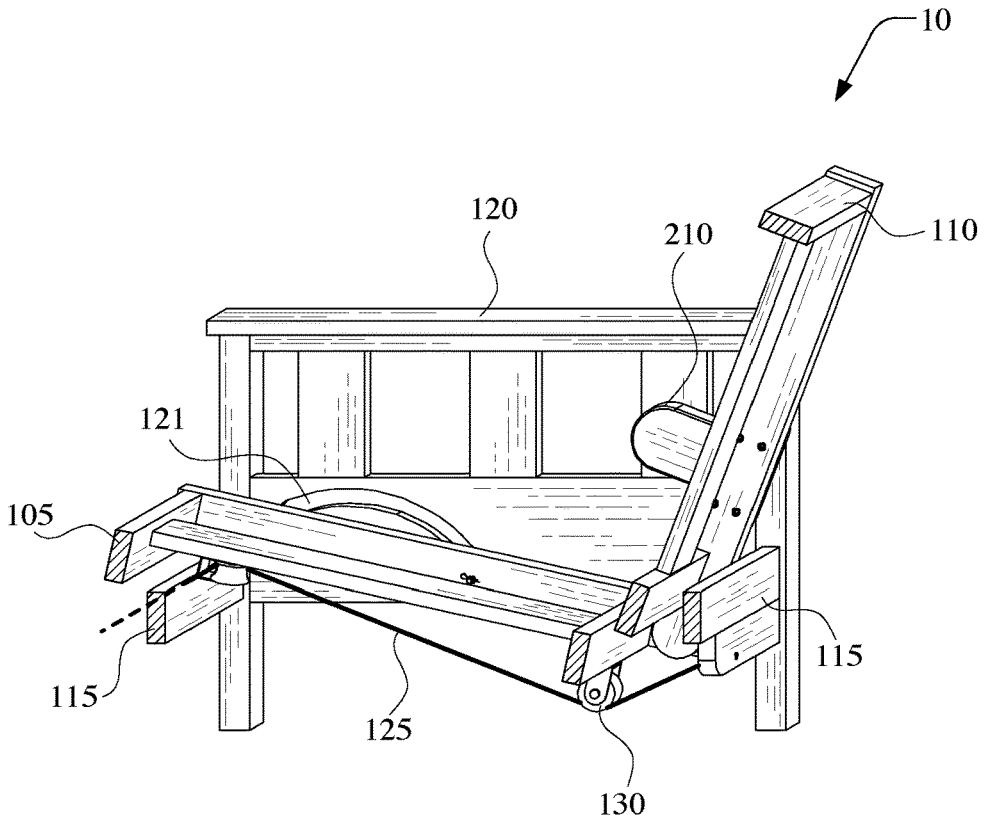
Figure 20:
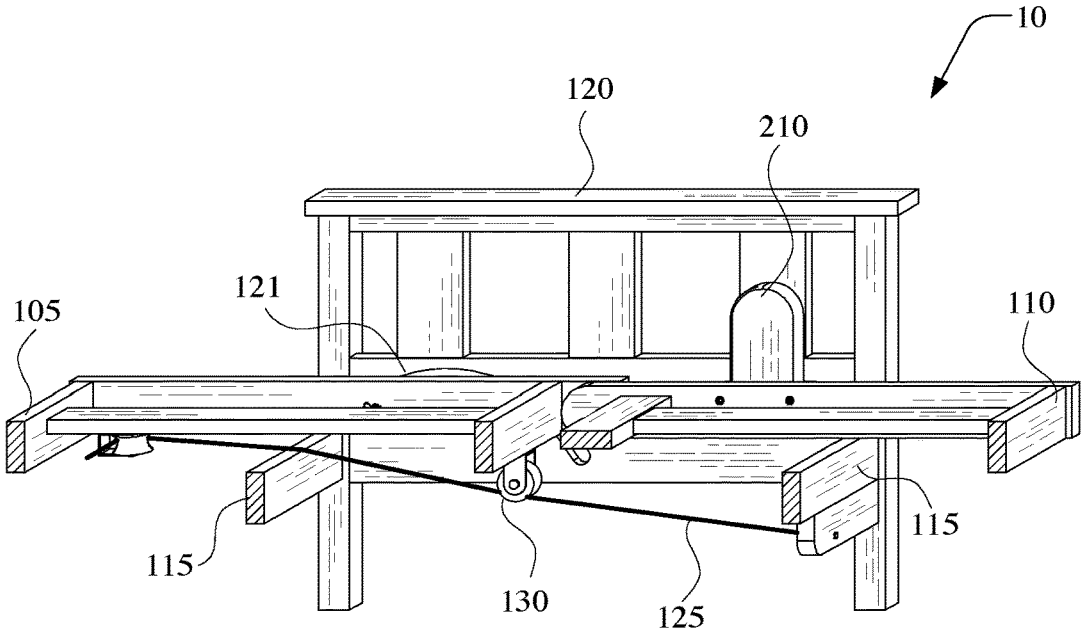

FIGS. 12 to 14 illustrate a foldable bed frame 10 having a two-part bed 11 according to some example embodiments.

Referring to FIGS. 12 to 14, the foldable bed frame 10 may include a two part bed 11. The bed 11 may be separated into an upper part corresponding to the back deck 110 and a lower part corresponding to the seat deck 105. Further, as illustrated in FIGS. 7 to 9, one or more of the back deck 110 and the seat deck 105 may include springs therein. The springs may be configured to assist the slats 205 by providing additional support for the bed 11. Further the springs may to absorb shock and reduce wear to the bed 11.

In some example embodiments, one or more of the back deck 110 and the seat deck 105 may be upholstered such that the upper part and/or lower part of the bed 11 may be fixed thereto. In one example embodiment the lower part of the bed 11 is fixedly attached to the seat, and the upper part of the bed 11 is removable from the back. In this configuration the additional weight of the lower part of the bed 11 fixedly attached to the seat, and the removal of the upper part of the bed 11 and the corresponding weight thereof from the back, further increases the mechanical advantage of the seat deck as a lever when operated with the fixed pivot point as the fulcrum.

Since the weight of the bed 11 fixed to the foldable bed frame 10 may be known, the hanger 210 may be designed and positioned taking into consideration the known weight of the bed 11.

FIGS. 15 to 20 illustrate a foldable bed frame 10 including an assistance mechanism according to an example embodiment.

Referring to FIGS. 15 to 20, as discussed above, the foldable bed frame 10 may pivot about the fulcrum which, due to the hanger 210, is offset higher on the back deck 110 while still allowing the back deck 110 to rest at a height corresponding to the height of the seat deck 105 when the foldable bed frame 10 is converted into the sleeping platform 200. Therefore, less force may be required to transition to foldable bed 10 from the unfolded state to the folded state. Further, as discussed above, in some example embodiments, one or more of the back deck 110 and the seat deck 105 may be upholstered. However, in other example embodiments, the foldable bed frame may not be upholstered, and, instead, a user may supply their own bed 11. Since the user's bed 11 may be heavier than a standard bed 11, the offset may not sufficiently counterbalance the weight of the bed 11.

Therefore, as illustrated in FIGS. 15 to 20, the foldable bed frame 10 may include an assistance device 125. The assistance device 125 may be configured to store elastic energy, and release the stored elastic energy to assist the user in transitioning the foldable bed frame 10 from the unfolded state to the folded state. Elastic energy as used herein may refer to any potential mechanical energy stored in a configuration of a material and/or a physical system as work is performed to distort a volume or shape of the material and/or physical system. The elastic energy may occur or be stored in the material and/or physical system when the material and/or physical system is compressed and stretched.

In some example embodiments, as illustrated in FIGS. 15 to 20, the assistance device 125 may be an elastic cord or a bungee cord wound around one or more pulleys 130. The elastic cord 125 may be composed of one or more elastic strands forming a core. The core may be covered in a woven cotton or polypropylene sheath that is braided with its strands spiraling around the core so that a longitudinal pull causes the sheath to squeeze the core, transmitting the core's elastic compression to the longitudinal extension of the sheath and cord 125.

In some example embodiments, a plurality of pulleys 130 may be installed on a bottom surface of the seat deck 105. For example, at least two pulleys 130 may be located on opposite ends of a front of the bottom surface of the seat deck 105 positioned in a first direction, and at least two pulleys 130 may be located on opposite ends of a rear of the button surface of the seat deck 105 positioned in a second direction, where the second direction is 90 degrees different from the first direction.

One end of the elastic cord 125 may be secured to a first side of a stretcher rail 115, and run through the plurality of pulleys 130 along the seat deck 105, and finally be secured to a second side of stretcher rail 115.

When the foldable bed frame 10 is in the unfolded state, the elastic cord 125 stores elastic energy; when the foldable bed frame 10 transitions from the unfolded state to the folded state, the elastic cord 125 is configured to release the stored elastic energy during the transition from the unfolded state to the folded state.

It should be noted that the assistance device 125 may be any type of device, mechanism, and/or physical system that is configured to store elastic energy.

Figure 21:
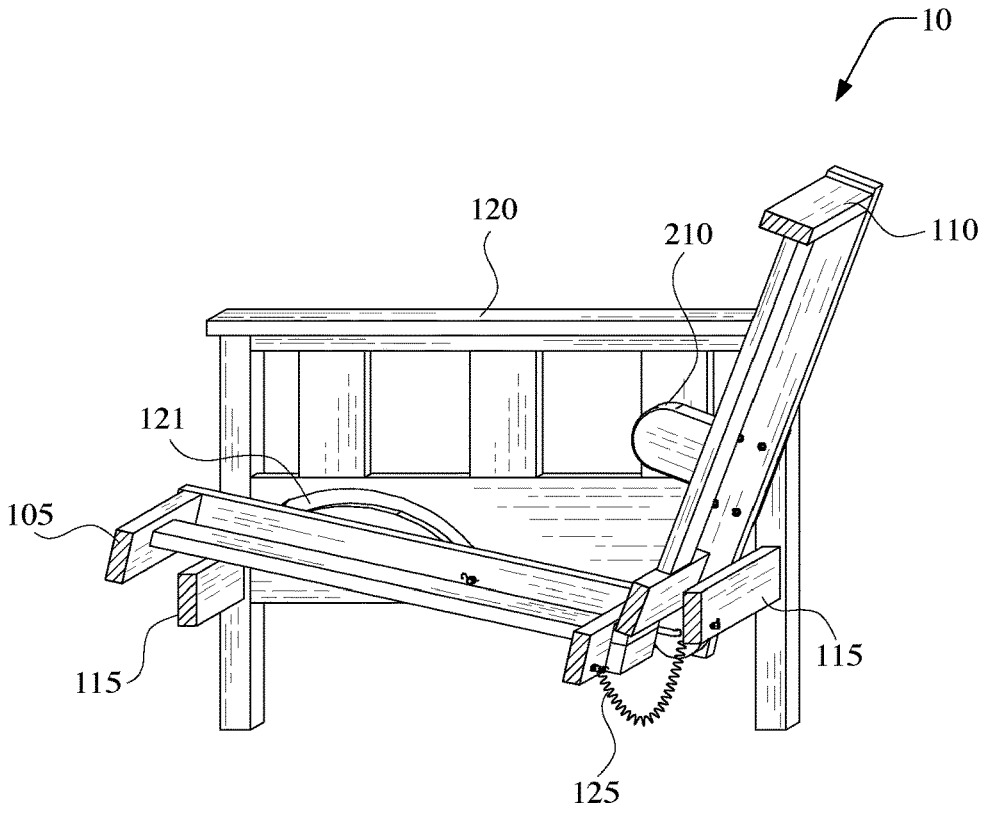
FIGS. 21 and 22 illustrate a foldable bed frame including an assistance mechanism according to other example embodiments.
Figure 22:
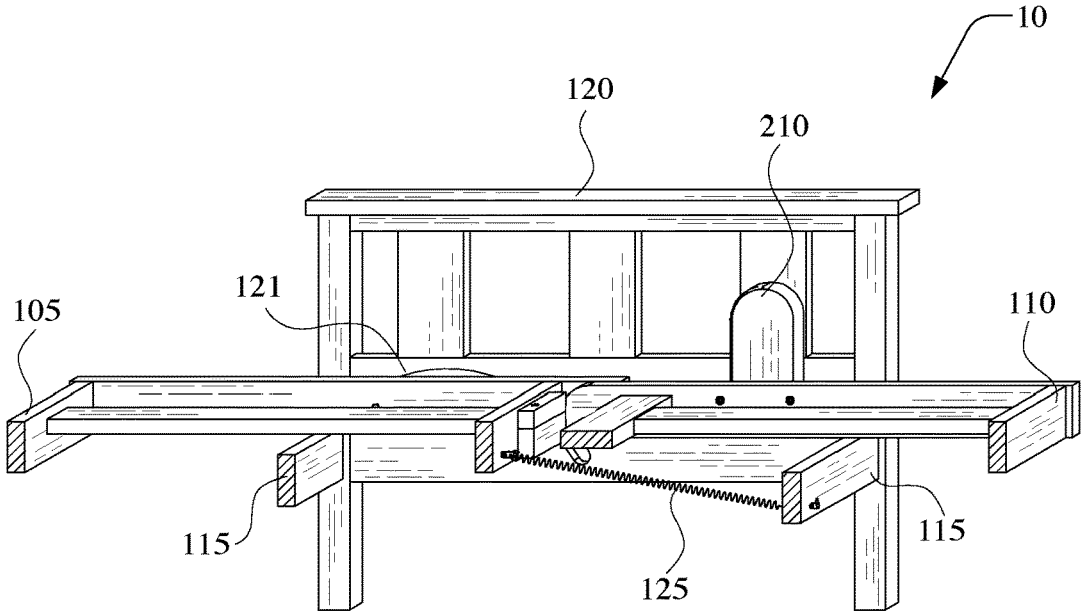

FIGS. 21 and 22 illustrate a foldable bed frame 10 including an assistance mechanism according to other example embodiments.

Referring to FIGS. 21 and 22, in other example embodiments, the assistance device 125 may be a spring.

For example, the assistance device 125 may be an extension spring configured to store elastic energy as tension is applied to the extension spring, the extension spring being formed as a coil. By way of another example, the assistance device 125 may be a compression spring configured to store elastic energy as a compressive force is applied to the compression spring.

In some example embodiments, the spring 125 may be connected, via a first end, to a stationary portion of the foldable bed frame and, via a second end, to a movable portion of the foldable bed frame. For example, the first end of the spring 125 may be connected to a portion of at least one of the rails 115, and the second end of the spring 125 may be connected to a portion of the seat deck 105. Alternatively, the second end of the spring 125 may be connected to a portion of the back deck 110.

It should be noted that, although the figures shows one end of the elastic object being attached to the seat deck 105, in various other example embodiments, the elastic object 125 may be connected to the back deck 110.

As shown in FIGS. 21 and 22, when the foldable bed frame 10 transitions from the folded state to the unfolded state, the spring may store elastic energy by extending. The stored elastic energy may be used to assist a transition from the unfolded state back to the folded state.

Figure 23:
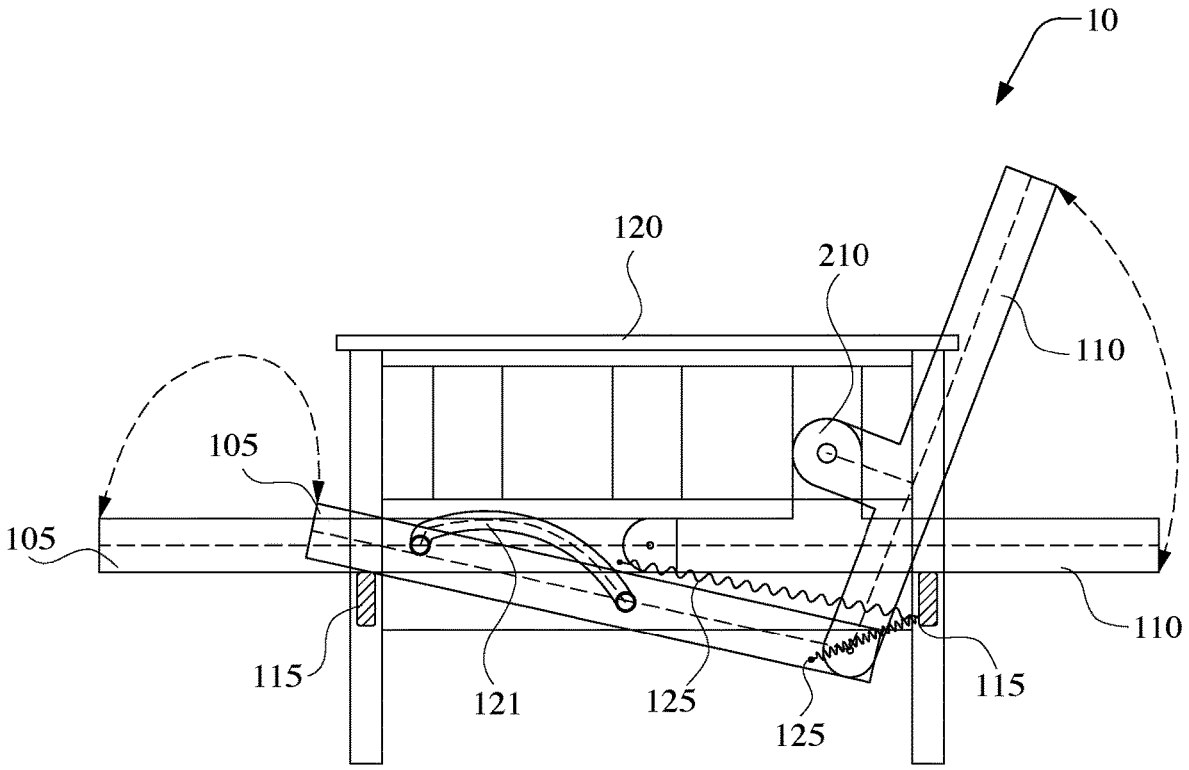
FIG. 23 shows a method for placing the foldable bed frame in the folded position and/or the unfolded position according to an example embodiment.

FIG. 23 shows a method for placing the foldable bed frame in the folded position and/or the unfolded position according to an example embodiment.

The arrows shown in FIG. 23 indicate a movement of the seat deck 105 relative to the back deck 110 (or alternatively, a movement of the back deck 110 relative to the seat deck 105).

In addition to the example embodiments discussed herein, some example embodiments also relate to converting or otherwise configuring a conventional foldable bed frame as a foldable bed frame 10. A method converting a conventional foldable bed frame into the foldable bed frame 10 may include installing a hanger 210 between the back deck 110 and the arm rests 120 to move the fulcrum of the foldable bed frame 10 further up the back deck 110 to counterbalance the weight of the back deck 110. Further in some example embodiments, an assistance device 125 may be installed to assist in transitioning the foldable bed frame 10 from an unfolded state to a folded state. For example, in some example embodiments, a plurality of pulleys 130 may be installed on a bottom surface of a seat deck and a back deck of a conventional foldable bed frame 10. One end of an elastic cord 125 may be secured to a back deck piece 110 associated with the back deck, and run through the plurality of pulleys 130 and secured to a second side of the back deck piece 110. In other example embodiments, a first end of a spring 125 may be secured to a static portion of the conventional foldable bed frame, and a second end of the spring 125 may be secured to a sleeping platform of the conventional foldable bed frame.

Furthermore, example embodiments also provide that the foldable bed frame may be assembled from a kit or other like grouping of components. The kit may include a first armrest piece 120, a second armrest piece 120, a back deck piece 110, a seat deck piece 105, a first rail 115, a second rail 115, and an elastic object 125. Each of the first armrest piece 120, the second armrest piece 120, the first rail 115, and the second rail 115 are configured to connect to each other such that each of the first rail 115 and the second rail 115 are perpendicular to each of the first armrest piece 120 and the second armrest piece 120. The seat deck piece 105 is configured to connect to the back deck piece 110 to form a sleeping platform 200. A first seat deck protrusion 106 of the seat deck piece 105 is configured to be received by a guide 121 in the first armrest piece 120, and a second seat deck protrusion 106 of the seat deck piece 105 is configured to be received by a guide 121 in the second armrest piece 120. Each of the guide 121 in the first armrest piece 120 and the guide 121 in the second armrest piece 120 are configured to guide a movement of the foldable bed frame from a folded state to an unfolded state, and vice versa. An armrest protrusion 122 of the first armrest piece 120 is configured to be received by a first back deck opening 113 of the back deck piece 110, and an armrest protrusion 122 of the second armrest piece 120 is configured to be received by a second back deck opening 113 of the back deck piece 110.

In some example embodiments, a first portion of the elastic object 125 is configured to connect to a portion of the seat deck piece 105 and/or a portion of the back deck piece 110. A second portion of the elastic object 125 is configured to connect to one of the first rail 115, the second rail 115, and/or any other static portion of the foldable bed frame 10.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A frame subassembly of a foldable bed frame, the foldable bed frame including a seat deck, a back deck and armrests, the armrests including a protrusion fixedly extending therefrom to define a fixed pivot point between the back deck and the armrests, the frame subassembly comprising:

at least one hanger including a first end and a second end, the first end of the at least one hanger being fixedly attached to a side rail of the back deck, and the second end of the at least one hanger configured to hang non-fixedly on the protrusion of a respective one of the armrests such that the hanger and the back deck are configured to swing from the protrusion along an arc while the back deck pivots about the fixed pivot point and the side rail of the back deck remains stationary with respect to the first end of the at least one hanger.

2. The frame subassembly of claim 1, wherein the fixed pivot point between the back deck and the armrests does not slide and the at least one hanger rotates together with the back deck about the fixed pivot point when the foldable bed frame transitions between a folded state and an unfolded state.

3. A foldable bed frame comprising:

armrests each including a protrusion fixedly extending therefrom; and a back deck fixedly attached to and hanging from a first end of at least one hanger, a second end of the at least one hanger configured to hang from the protrusion to define a fixed pivot point between the back deck and the armrests such that the back deck is configured to move between a substantially horizontal position and a substantially vertical position as the back deck swings along an arc defined by a pivoting action of the hanger about the fixed pivot point while the back deck remains stationary with respect to the first end of the at least one hanger.

4. The foldable bed frame of claim 3, wherein the armrests each including a groove therein, and foldable bed frame further comprises:

a seat deck including a roller connected to a side rail of the seat deck, the roller configured to sit in the groove of a respective one of the armrests such that the roller moves along a path defined by the groove.

5. The foldable bed frame of claim 3, wherein the fixed pivot point between the back deck and the armrests does not slide and the at least one hanger rotates together with the back deck about the fixed pivot point when the foldable bed frame transitions between a folded state and an unfolded state.

6. A foldable bed frame configured to transition between a seating position and a sleeping position, the foldable bed frame comprising:

armrests each including a curved groove therein extending within the armrests such that a first end of the curved groove having a notch therein is closer to a front of the armrests than a second end of the curved groove; and a seat deck including a roller extending from a side rail of the seat deck towards the armrests, the roller configured to move along the curved groove of a respective one of the armrests such that the seat deck moves from an angled pitch associated with the seating position to a substantially horizontal position associated with the sleeping position as the roller moves from the second end to the first end of the curved groove in the respective one of the armrests.

7. The foldable bed frame of claim 6, wherein the roller is configured to move along the curved groove of the respective one of the armrests, and to drop into the notch in the groove when the roller reaches the notch in the first end of the curved groove.

8. The foldable bed frame of claim 7, further comprising:

a back deck hingeably attached to the armrests via a fixed pivot point, wherein the seat deck moves from the angled pitch associated with the seating position to the substantially horizontal position associated with the sleeping position while the back deck pivots about the fixed pivot point, and the roller is configured to drop into the notch in the first end of the curved groove of the respective one of the armrests to lock the back deck when the seat deck moves to the substantially horizontal position associated with the sleeping position such that the back deck is restricted from being lifted to transition the foldable bed frame from the sleeping position into the seating position.

9. The foldable bed frame of claim 8, wherein when the roller drops into the notch in the curved groove of the respective one of the armrests, the seat deck is not restricted from being lifted to transition the foldable bed frame from the sleeping position to the seating position.

10. The foldable bed frame of claim 8, wherein one or more of the seat deck and the back deck are upholstered such that at least a portion of a bed is fixed to the foldable bed frame.

11. The foldable bed frame of claim 6, wherein the armrests each include the curved groove therein such that the curved groove forms a concave downwards arc.

* * * * *